US008234889B2

(12) United States Patent
Kim et al.

(10) Patent No.: US 8,234,889 B2
(45) Date of Patent: Aug. 7, 2012

(54) LAUNDRY MACHINE

(75) Inventors: Na Eun Kim, Seoul (KR); Sung Min Kim, Seoul (KR); Dong Won Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 790 days.

(21) Appl. No.: 12/145,666

(22) Filed: Jun. 25, 2008

(65) Prior Publication Data

US 2009/0139273 A1 Jun. 4, 2009

(30) Foreign Application Priority Data

Dec. 3, 2007 (KR) ..... 10-2007-0124526

(51) Int. Cl.
*D06F 37/20* (2006.01)
*D06F 29/00* (2006.01)

(52) U.S. Cl. ..... 68/23.1; 68/27; 68/140

(58) Field of Classification Search ..... 68/12.06, 68/13 R, 23.1, 23.3, 27, 140
See application file for complete search history.

(56) References Cited

U.S. PATENT DOCUMENTS

| | | | | |
|---|---|---|---|---|
| 5,117,659 | A * | 6/1992 | Sharp et al. | 68/23.3 |
| 5,784,901 | A | 7/1998 | Yanase et al. | |
| 6,618,887 | B2 * | 9/2003 | Kim et al. | 8/158 |
| 6,732,552 | B2 * | 5/2004 | Kim et al. | 68/12.26 |
| 7,624,600 | B2 * | 12/2009 | Sunshine et al. | 68/3 R |
| 2002/0056293 | A1 * | 5/2002 | Kin et al. | 68/12.26 |
| 2004/0221624 | A1 * | 11/2004 | Fumagalli | 68/17 R |
| 2005/0275325 | A1 * | 12/2005 | Yang | 312/330.1 |
| 2006/0059960 | A1 | 3/2006 | Hansen | |
| 2006/0156765 | A1 * | 7/2006 | Sunshine et al. | 68/13 R |
| 2007/0266740 | A9 * | 11/2007 | Kendall et al. | 68/3 R |
| 2010/0064736 | A1 * | 3/2010 | Jeong et al. | 68/13 R |

FOREIGN PATENT DOCUMENTS

| | | |
|---|---|---|
| DE | 2100343 | 7/1971 |
| JP | 10-15275 | 1/1998 |
| KR | 10-2001-0093876 | 10/2001 |
| KR | 10-2004-0009400 | 1/2004 |
| KR | 10-0701329 | 3/2007 |
| RU | 2 058 454 | 4/1996 |
| WO | WO 2008/069607 | 6/2008 |

OTHER PUBLICATIONS

European Search Report dated Apr. 3, 2009.
International Search Report dated May 28, 2010.
Russian Notice of Allowance dated Aug. 31, 2011. (Application No. 2010127306).

* cited by examiner

*Primary Examiner* — Joseph L Perrin
(74) *Attorney, Agent, or Firm* — Ked & Associates LLP

(57) ABSTRACT

A laundry machine is provided capable of washing or drying laundry. The laundry machine, includes a cabinet, a first washing tub that receives laundry disposed within the cabinet, a housing disposed adjacent the cabinet, a second washing tub provided within the housing that receives laundry, and at least one support device that supports the second washing tub with respect to the housing, substantially preventing vertical displacement of the second washing tub due to the weight of the second washing tub and limiting the displacement of the second washing tub due to vibration thereof.

18 Claims, 7 Drawing Sheets

LAUNDRY MACHINE

This application claims priority to Korean Patent Application No. 10-2007-0124526, filed in Korea on Dec. 3, 2007 which is hereby incorporated by reference in its entirety.

BACKGROUND

1. Field

A laundry machine capable of washing and/or drying laundry is disclosed herein.

2. Background

Laundry machines are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
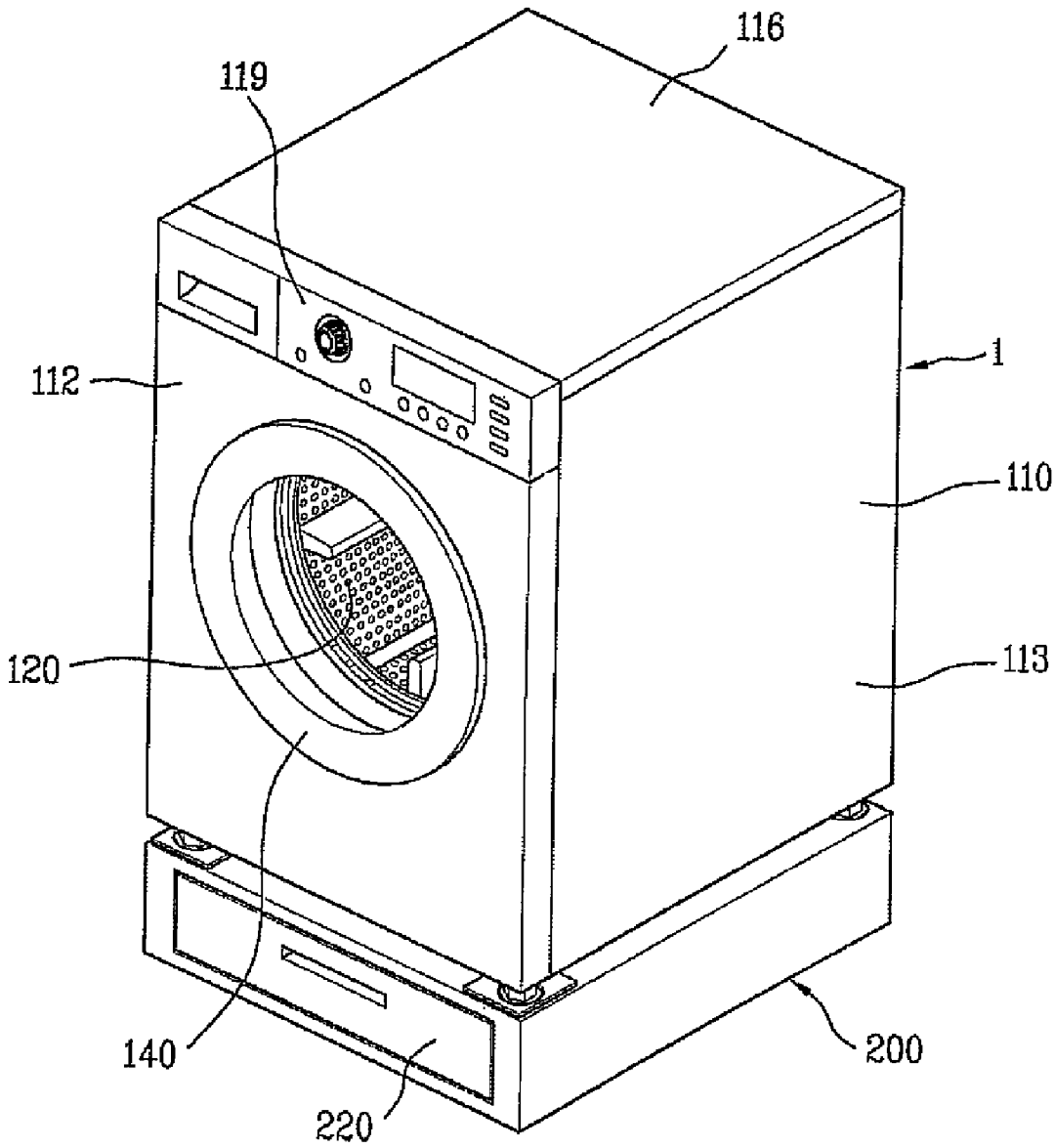
FIG. 1 is a front perspective view of a laundry machine according to an embodiment.

A washing machine is an electric home appliance capable of washing laundry, and a drying machine is an electric home appliance drying capable of drying laundry. Recently, electric home appliances combining the functions of the washing machine and the drying machine have been widely used. Hereinafter, for the sake of explanatory convenience, the washing machine, the drying machine, and the electric home appliances combining these functions of will be commonly called a laundry machine.

Laundry machines may generally be classified as a top loading type or a front loading type according to the way in which the laundry is loaded therein. Further, laundry machines may be classified as a vertical axis type laundry machine whose drum or pulsator rotates around a vertical axis or a horizontal axis type laundry machine whose drum rotates around a horizontal axis.

Conventional laundry machines are generally installed directly on a floor or surface. An inlet of a front loading type laundry machine is generally positioned low, such that it is inconvenient for a user to put laundry into and take laundry out of the laundry machine. Thus, there is a need for a height of the inlet of the laundry machine to be raised.

Further, generally each home is provided with one laundry machine. In order to wash different types of laundry, the washing machine must be used or run several times. For example, laundry may be divided into adult clothing, and underwears and baby clothing, and the washing machine must be used twice in order to wash separately both the latter and the former. Thus, a lot of washing time is required and a lot of energy consumed.

Also, in order to conserve or save energy, it is not preferable to use a large-sized laundry machine when washing a small amount of clothing. The washing course provided in the large-sized laundry machine generally consumes a large amount of water. Further, a lot of power is consumed rotating a large-sized drum or pulsator.

Also, since the washing course is configured for a large amount of laundry, the washing time is comparatively long. Additionally, since the washing course for the large-sized laundry machine is configured for mainly general clothing, it may not be suitable for washing delicate clothing, such as underwear or baby clothing.

In the case in which a small amount of laundry is frequently washed, the large-sized washing machine is not suitable. Thus, a user gathers laundry over several days or more in order to wash a suitably large load of laundry. However, it is not sanitary for underwear, baby clothing, and similar items to be left for a long time. If such laundry is left for a long time, dirt clings to the clothing making it difficult to completely clean it.

Thus, the need for a small-sized laundry machine having a much smaller capacity than the conventional large-sized laundry machine has increased. However, despite the small-size, it is not preferable to provide two laundry machines in one home in view of space utilization appearance.

Figure 2:
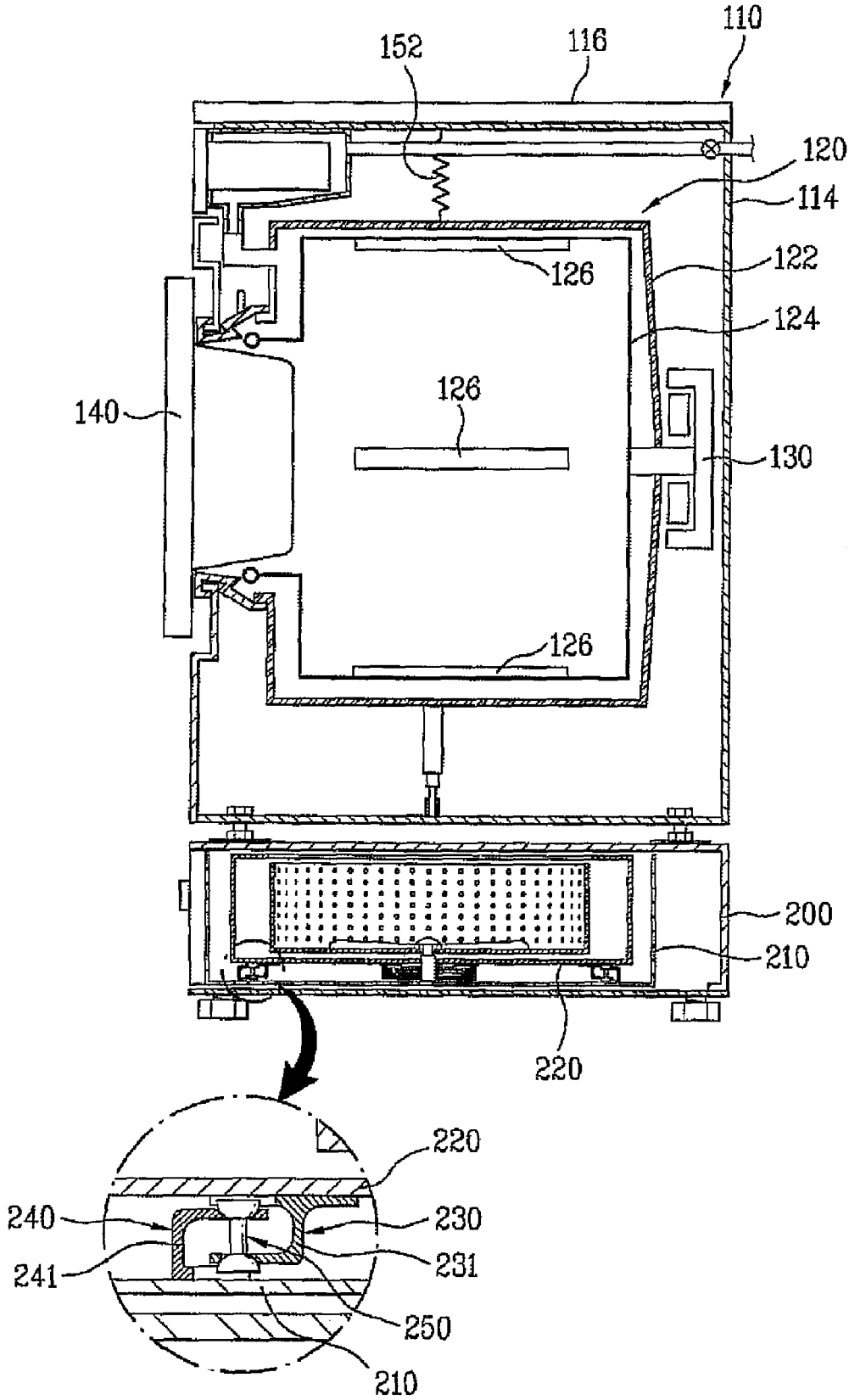
FIG. 2 is a side, cross-sectional view of the laundry machine of FIG. 1.

FIG. 1 is a front perspective view of a laundry machine according to an embodiment. FIG. 2 is a side, cross-sectional view of the laundry machine of FIG. 1.

The laundry machine 1 of FIG. 1 includes a cabinet 110, and a first washing tub 120 provided within the cabinet 110. The cabinet 110 may include a front cover 112, sidewalls 113, a rear wall 114, and a top cover or plate 116. Further, the front cover 112 of the cabinet 110 may be provided with a door 140 and a front upper portion of the cabinet 110 may be provided with a control panel 119 for operating the laundry machine 1.

The first washing tub 120 may include a first tub 122 that stores washing water and a first drum 124 rotatably disposed in the first tub 122. The first tub 122 and the first drum 124 may be provided with an opening through which laundry may be input and withdrawn from the washing tub 120 when the door 140 is opened. Also, the first drum 124 may be rotated by a motor 130. Lifts 126 may be provided in the first drum 124 to lift up the laundry within the first drum 124 when rotated.

The opening part may be formed to face up rather than toward the front of the cabinet. Further, the first washing tub may be oriented such that its central longitudinal axis extends vertically rather than horizontally.

When the door 140 of the laundry machine 1 is formed in the front of the cabinet 110, a user must bend his body to put laundry into and withdraw the laundry from the inside of the first washing tub 120. Therefore, in order to prevent the user from excessively bending his body, the washing tub 120 should be positioned at a predetermined height.

As shown in FIGS. 1 and 2, a case 200 that increases the height of the first washing tub to a predetermined height may be used under the laundry machine 1. The case 200 may be formed to have a predetermined height so that the cabinet 110 of the laundry machine 1 may be raised. Also, the case 200 may be formed to have a predetermined space in an inside thereof so as to receive laundry inside the space to efficiently use space.

Also, in order for the user to conveniently put laundry into and withdraw laundry from inside the case 200, the inside of the case 200 has a predetermined space capable of receiving laundry therein and may be further provided with a housing 210 configured to be inserted into and withdrawn from the space of the case 200.

Figure 3:
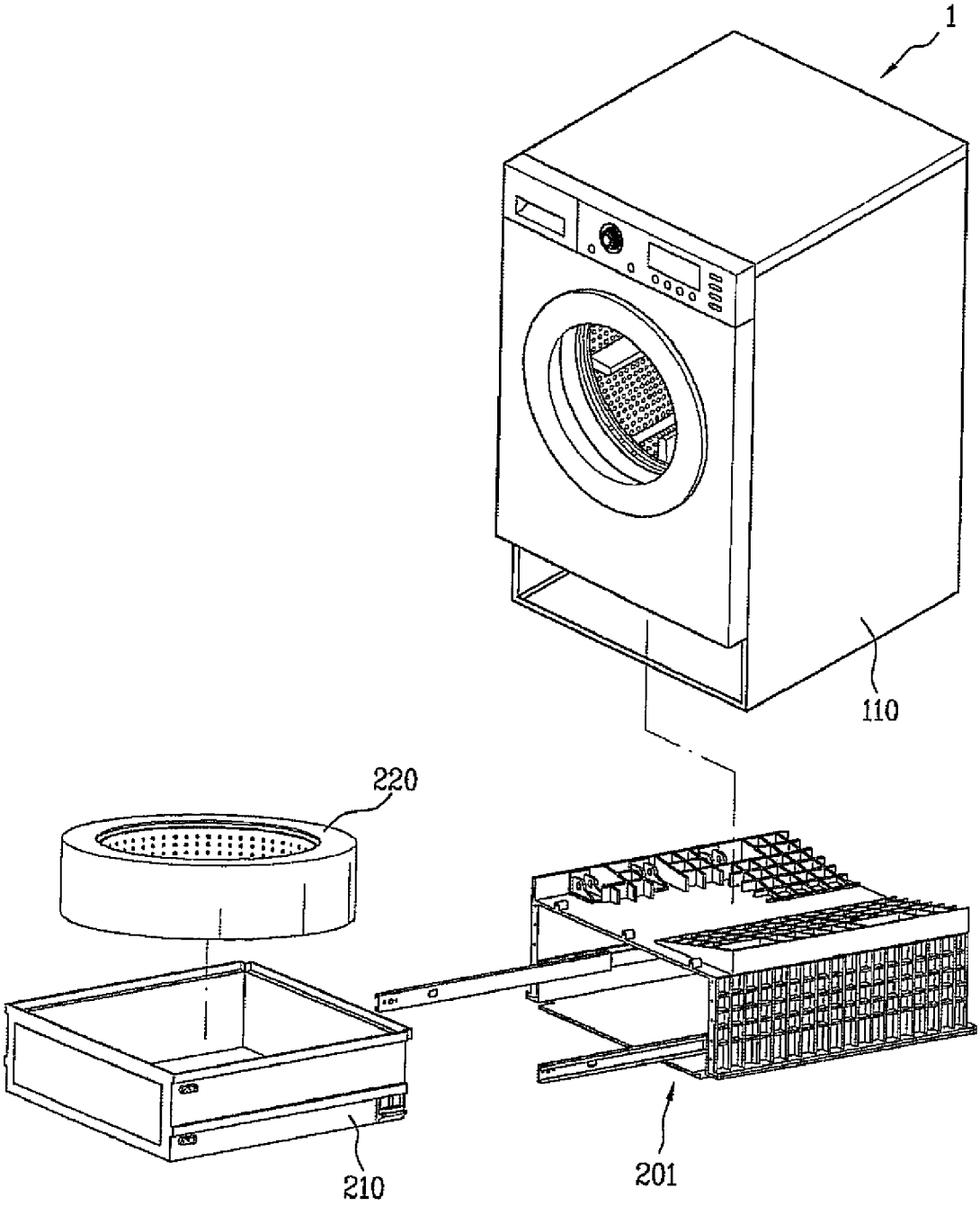
FIG. 3 is an exploded perspective view of a laundry machine according to another embodiment.
Figure 4:
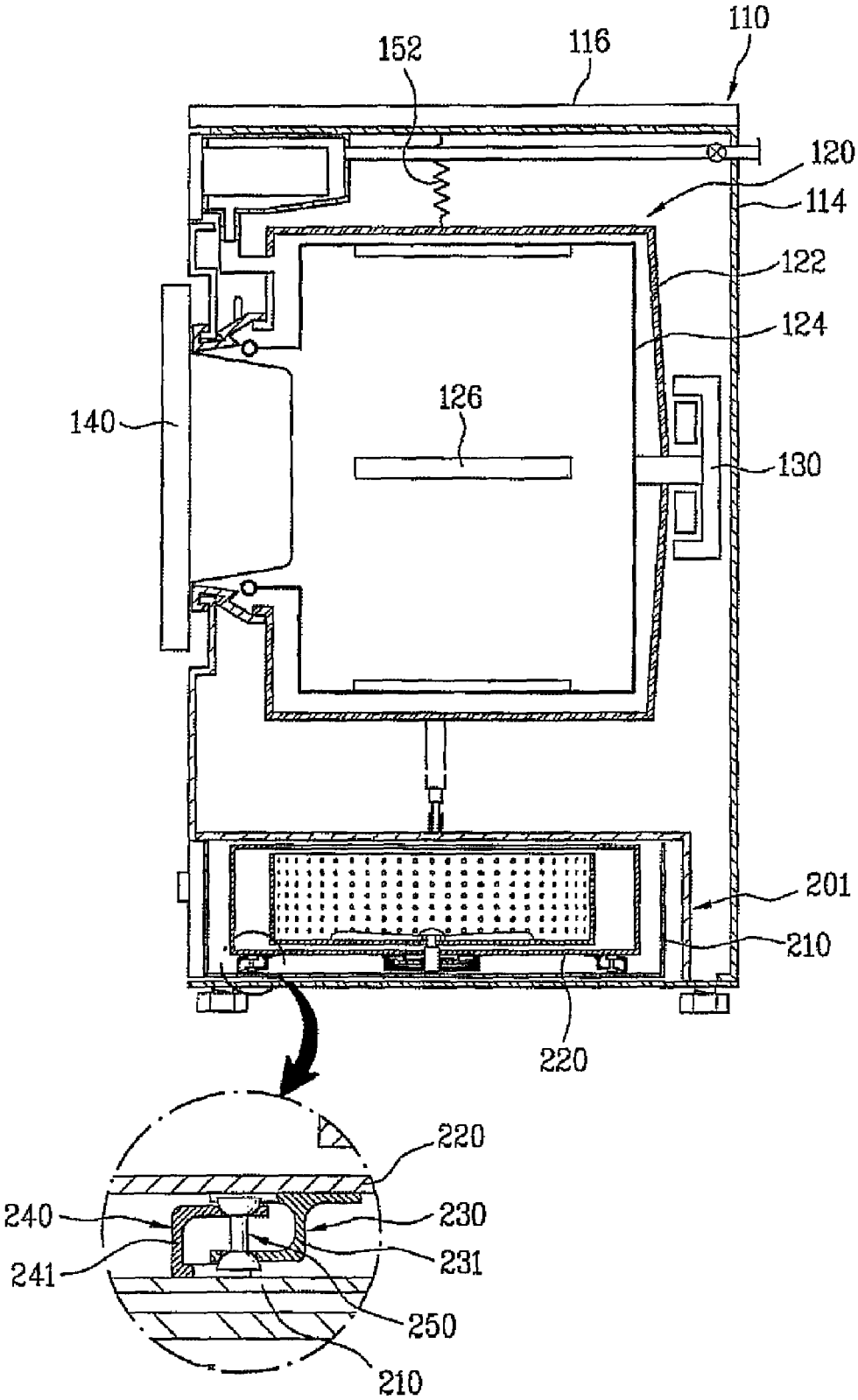
FIG. 4 is a side cross-sectional view of the laundry machine of FIG. 3.

The case 200, as discussed above, may be installed at a lower portion of the cabinet 110. However, it may also be installed at an upper side or a side portion thereof, as needed, although not shown in the drawings. Further, as discussed above, the housing 210 may be provided inside of the case 200 separately provided from the cabinet 110 which receives the first washing tub 120. Alternatively, as shown in FIGS. 3 and 4, the case 200 may be provided inside the cabinet 110 integrated therewith. In such a case, a sub-housing 201 may be provided with rails 201*a*, 201*b* that allow the housing 210 to be inserted into and withdrawn from the cabinet 110.

The housing 210 may be disposed below the first washing tub 120. Also, the housing 210 may be provided inside the cabinet 110, or inside of the case 200 which provide a predetermined space to receive the housing 210.

A second washing tub 220 capable of receiving laundry separately from the first washing tub 120 and performing washing may be disposed inside the housing 210. Further, the second washing tub 220 may be operated by the controller 119 provided in the cabinet 110. The second washing tub 220 may be operated independently from the first washing tub 120, and may include a second tub 220 that receives washing water and a second drum disposed within the second tub. Also, the second washing tub 220 may include a pulsator provided to be rotatable in the second tub 220. Further, other types of washing tubs not described in the present description may be utilized with the embodiments disclosed herein.

Because the second washing tub 220 is provided, separate from the first washing tub 120, washing may be promptly performed by selecting a proper washing tub depending on an amount of laundry to be washed, without wasting washing water and energy. Also, because the first washing tub 120 and the second washing tub 220 each are separately and independently operated, they may be configured to perform different washing methods, and a user may select and use the more appropriate washing tub based on the type and characteristics of the laundry to be washed, improving washing efficiency and reducing clothing damage. Further, dark colored clothes and light colored clothes are often classified and washed separately in order to prevent them from dyeing one another. The first washing tub 120 and the second washing tub 220 may be utilized to wash different loads at once without performing two washing cycles, reducing washing time.

As shown in FIGS. 2 and 4, the second washing tub 220 may be received inside of the housing 210, as described above, and vibration may be generated depending on an eccentricity of the laundry distribution when the second washing tub 220 rotates. Also, there may be a tendency for the washing tub 220 to fall into a lower side of the housing 210 due to the weight of the laundry and washing water.

However, a height of the housing 210 should not be too high for convenience sake in use. That is, if the height of the case 200 is too high, the opening part of the first washing tub 120 is positioned too high when the case 200 is provided below the first washing tub 120 which is inconvenient in use, and if the case 200 is provided at the upper portion of the first washing tub 120, the height of the second washing tub 220 becomes too high which is inconvenient in use.

Therefore, the height of the housing 210 should not be formed to be too high. Further, the housing 210 may include a support member 250 capable of supporting the second washing tub 220 and damping vibration in the space inside the housing 210.

The supporting and damping of the washing tub 220 may be made by means of a suspension including a cylinder, a piston, a spring, and a damper, and may be formed to be retractable; however, such a suspension, as described above, may be retracted depending on the weight of the washing tub, allowing the washing tub to fall so that it may be disadvantageous to use it for supporting the second washing tub 220, which is provided inside of the housing 210 and has a very narrow height and width.

Figure 5:
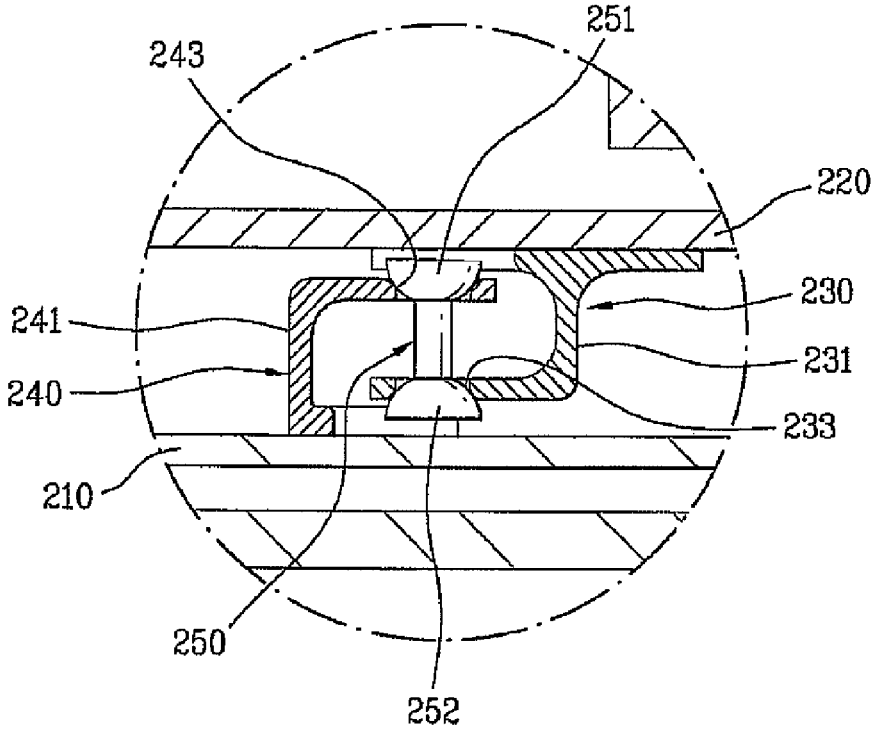
FIG. 5 is a side, partial cross-sectional view enlarging a support member of a laundry machine according to an embodiment.
Figure 6:
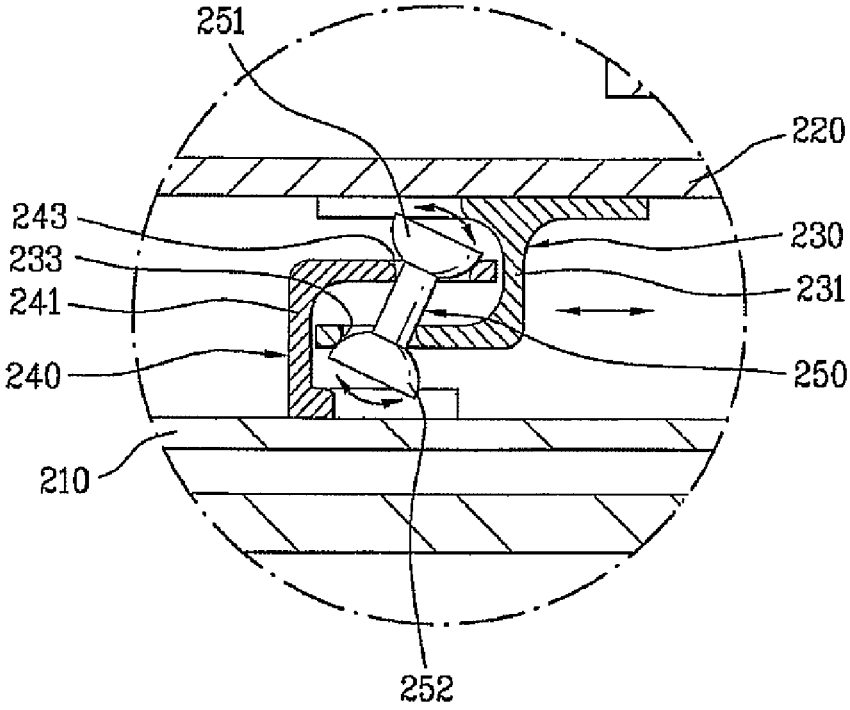
FIG. 6 is a side, partial cross-sectional view showing a state in which the support member of FIG. 5 rotates.

FIG. 5 is a side, partial cross-sectional view enlarging a support member of a laundry machine according to an embodiment. FIG. 6 is a side, partial cross-sectional view showing a state in which the support member of FIG. 5 rotates.

The support member 250 supports the second washing tub 220 provided inside of the housing 210 and dampens vibration. The support member 250 may be formed to prevent the second washing tub 220 from falling due to its load and to limit displacement generated due to the vibration of the second washing tub 220 within a predetermined range. Further, the support members 250 may be coupled to a first part 230 that vibrates integrally with the second washing tub 220 and a second part 240 that moves integrally with the housing 210, respectively. Further, the support members 250 may be coupled so as not to be removed from the first part 230 and the second part 240.

The support member 250 may be made of a rigid material so as not to be retracted or deformed regardless of a load of the second washing tub 220. Since the support member 250 may be made of a rigid material, while supporting the load of the second washing tub 220, the falling of the second washing tub 220 due to the load of the second washing tub 220 may be prevented.

Also, the support member 250 may be formed to receive a tensile force applied thereto due to the load of the second washing tub 220. In other words, a central longitudinal axis of the support member 250 may extend substantially perpendicular to the ground, wherein the second part 240 may be coupled to the lower end of the support member 250, and the first part 230 may be coupled to the upper end of the support member 250.

The support member may be configured to dampen the vibration conveyed from the second washing tub 220 by means of friction force. The portions where the friction occurs may be portions where the support member 250 is coupled to the first part 230 and the second part 240. Since the load of the second washing tub 220 acts on the portion where the friction occurs, it is possible to maximize the friction force.

In order that friction occurs in the portions where the support member 250 is coupled to the first part 230 and the second part 240 depending on the vibration of the second washing tub 220, the support member 250 may be coupled to be movable between the first part 230 and the second part 240 and may also be coupled to be rotatable with respect to the first part 230 and the second part 240. The support member 250 may be formed to have a clearance of a predetermined distance from the first part 230 and the second part 240. Further, the support member 250 may be coupled so that its rotating angle is limited within a predetermined angle range by interference between the support member 250 and the first part 230 and the second part 240.

Meanwhile, when the second washing tub 220 does not vibrate, the support member 250 may be positioned such that the second washing tub 220 may be returned to its original initial position. The support member 250 may be applied with tensile force due to the weight of the second washing tub 220. That is, the support member 250 may be applied with a force in a direction of a virtual line connecting ends of the support member and extending substantially vertical with respect to the ground, when the second washing tub 220 does not vibrate.

Hereinafter, the support member 250 of a laundry machine according to an embodiment will be described in more detail, with reference to FIGS. 5 and 6.

The first part 230 may include an upper bracket 231 provided on the second washing tub. The upper bracket 231 may be coupled to vibrate integrally with the second washing tub 220.

The second part may include a lower bracket 241 provided on housing 210. The lower bracket 241 may be coupled to move integrally with the housing 210.

The support members 250 may be coupled to the upper bracket 231 and the lower bracket 241, respectively. The lower bracket 241 may be coupled to the upper end of the support member 250 and the upper bracket 231 may be coupled to the lower end of the support member 250.

The upper bracket 231 may be coupled to a lower surface, or a side of the second washing tub 220 and may extend to face the lower side. A first hole 233 may penetrate through a lower or extended end of the upper bracket 231 and may be configured to receive a lower end of the support member 250. Also, the lower bracket 241 may be coupled to a lower surface or a side of the housing 210 and may extend to face the upper side. A second hole 243 may penetrate through an upper or extended end of the lower bracket 241 and may be configured to receive an upper end of the support member 250. The extended end of the lower bracket 241 may be positioned above the extended end of the upper bracket 231. Therefore, the support member 250 may be applied with tensile force due to the load of the second washing tub 220.

The first hole 233 and the second hole 243 each may be formed to have a larger diameter than a portion of the support member 250 extending therethrough. Further, ends of the support member 250 may be formed to have a larger diameter than the diameters of the first hole 233 and the second hole 243. That is, constraint parts 251, 252 having a larger diameter than the diameters of the first hole 233 and the second hole 243 may be provided at both ends of the support member 250, respectively, as shown in FIGS. 5 and 6.

Thus, a clearance of a predetermined distance is formed between the support member 250 and the first hole 233 and the second hole 243; however, the support member is rotatable within a predetermined angle range. In operation, when the second washing tub 220 vibrates, the support member 250 rotates by means of the upper bracket 231 vibrating integrally with the second washing tub 220. Friction occurs between the constraint part 251, 252 of the support member 250 and the inner circumferential surfaces of the first hole 233 and the second hole 243 so that the vibration is dampened by the friction force. Also, if the vibration displacement of the second washing tub 220 exceeds a predetermined range, interference between the support member 250 and the upper bracket 231 and the lower bracket 241 occurs so that the rotating angle of the support member 250 is limited. Therefore, the vibration displacement of the second washing tub 220 may be limited.

Figure 7:
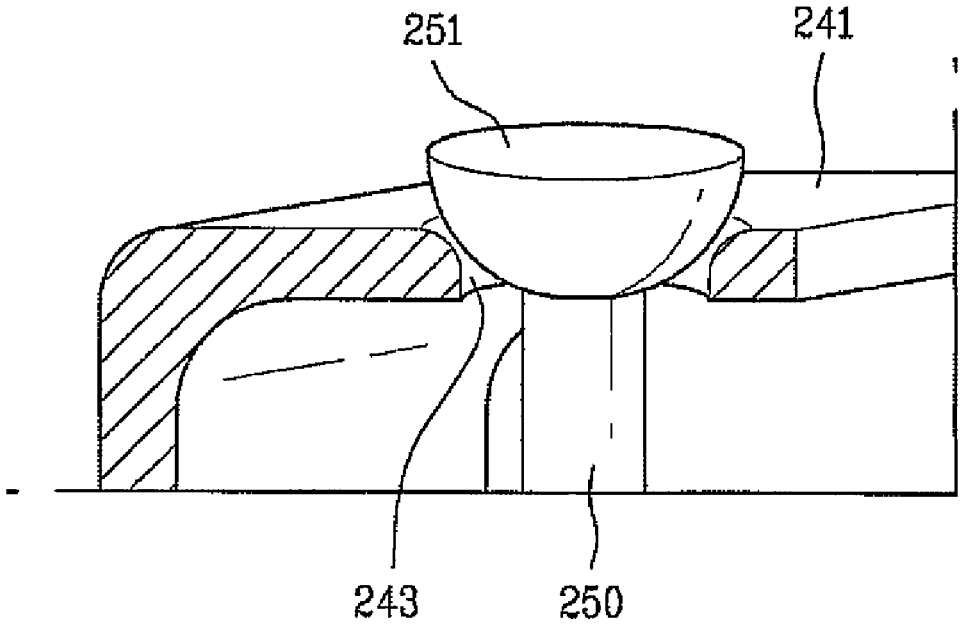
FIG. 7 is a partial cross-sectional view enlarging a coupling part between a support member and a lower bracket according to an embodiment.
Figure 8:
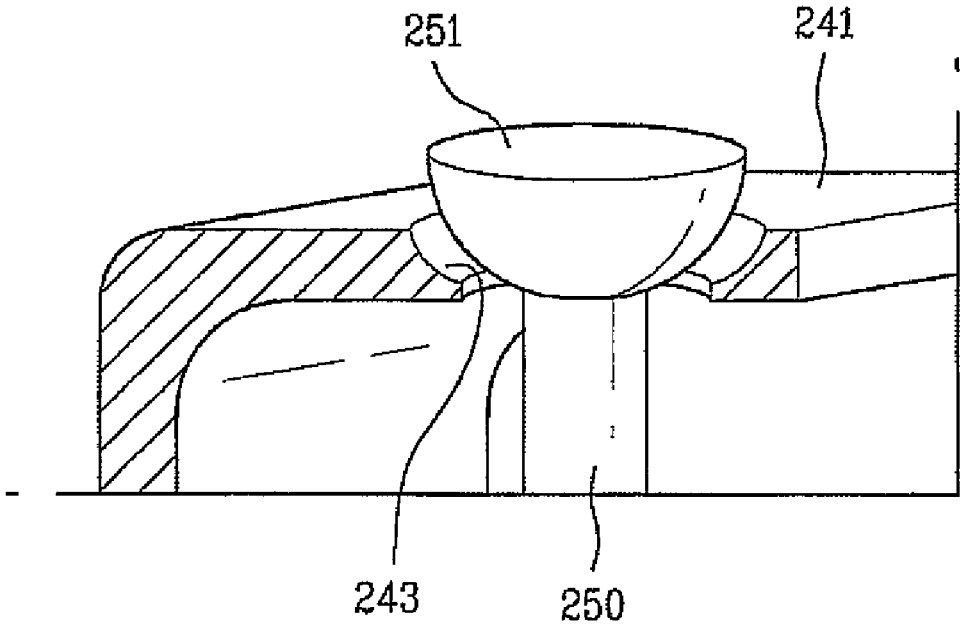
FIG. 8 is a partial cross-sectional view enlarging a coupling part between a support member and a lower bracket according to another embodiment.

As described above, the constraint parts 251, 252 and the first hole 233 and the second hole 243 may rub against each other when the support member 250 rotates. As shown in FIG. 7 or FIG. 8, the inner circumferential surfaces of the first hole 233 and the second hole 243 and the outer circumferential surface of constraint part 251, 252 may be formed to have approximately spherical contact surfaces, in order to promote smooth rotation of the support member 250. The shapes of the first hole 233 and the second hole 243 may be selected by one skilled in the art based on the necessary friction force between the constraint part 251, 252 and the first hole 233 and the second hole 243, and thus, may be formed in other shapes.

Also, any one of the inner circumferential surfaces of the first hole 233 and the second hole 243 or the outer circumferential surfaces of the constraint parts 251, 252 may be made of a resin material capable of maintaining friction coefficients and preventing noise generation. The support member 250 having the above described structure may receive a tensile force applied thereto due to the load of the second washing tub 220 so that it tends to return to a position in which its central longitudinal axis extends substantially vertical with respect to the ground. In other words, the support member 250 may receive a tensile force applied thereto such that a straight line connecting both ends of the support member 250 tends to return to a position in which its central longitudinal axis extends substantially vertical with respect to the ground. Therefore, the support member 250 always shows a tendency to rotate in a direction so as to extend substantially vertical to the ground. Therefore, although the second washing tub 220 suspended by means of the support member 250 may deviate from an initial position when vibrating, it returns to the initial position when not vibrating.

Figure 9:
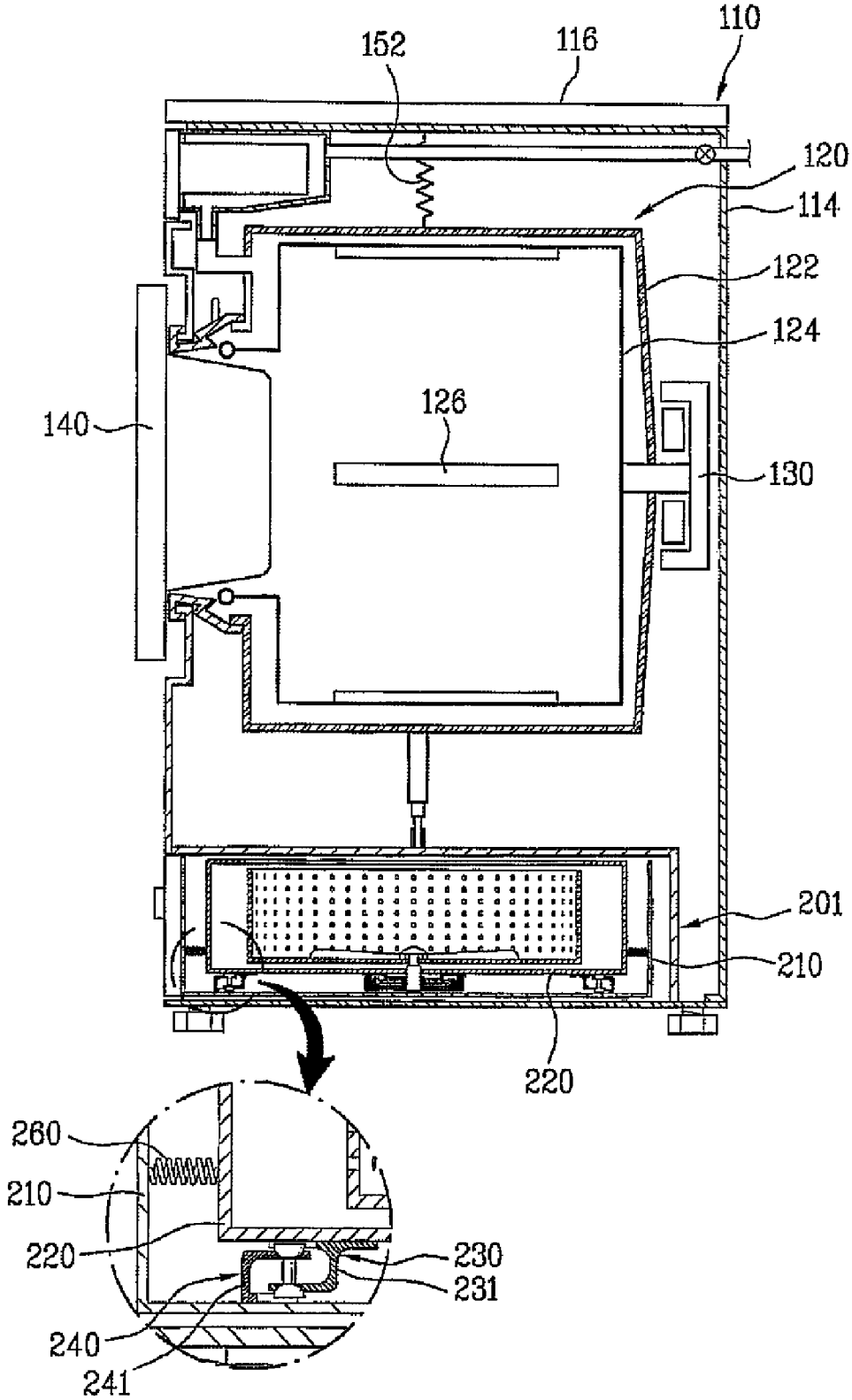
FIG. 9 is a side, cross-sectional view of a laundry machine having an elastic support part.

An elastic support part 260 elastically supporting right and left sides of the second washing tub 220 may further be provided. As shown in FIG. 9, the elastic support part 260 may be formed of a spring. Alternatively, the elastic support part 260 may be formed of a rubber band, or other elastic device.

One end of the elastic support part 260 may be coupled indirectly to the first part 230 vibrating integrally with the second washing tub 220, and the other end of the elastic support part 260 may be coupled indirectly to the second part 240 vibrating integrally with the housing 210, respectively. In other words, one end of the elastic support part 260 may be directly coupled to the second washing tub 220 or may be coupled to the upper bracket 231 vibrating integrally with the second washing tub 220, and the other end of the elastic support part 260 may be directly coupled to the housing 210 or may be coupled to the lower bracket 241 moving integrally with the housing 210.

Therefore, the elastic support part 260 may elastically support the right and left vibration of the second washing tub 220, making it possible to more efficiently dampen the vibration of the second washing tub 220.

A laundry machine according to embodiments disclosed herein has at least the following advantages.

Herein, the upper bracket 231 (or the first part 230), the lower bracket 241 (or the second part 240), and the support member 250 in combination are referred to as a support device.

First, because the height of the first washing tub of the laundry machine is increased, it may not be necessary for a user to excessively bend his body when putting laundry into and taking laundry out of the first washing tub, improving convenience in use. Second, because a small capacity second washing tub is installed adjacent the first washing tub, a user may select the washing tub appropriate for the amount of laundry to be washed, reducing unnecessary washing water and waste of energy. Third, because the second washing tub may be used in a different washing manner or method from that of the first washing tub, a proper washing manner or method may be selected depending on the type of laundry to be washed.

Fourth, as the displacement of the second washing tub due to its load may be substantially prevented or reduced, space utilization may be improved. Because the vibration displacement range may be limited and the vibration dampened with a simple structure, the size of the second washing tub may be enlarged or maximized. Fifth, because the second washing tub suspended by means of a support member is always returned to an initial position, stability may be improved.

Embodiments disclosed herein provide a laundry machine with improved convenience, a high positioned laundry inlet, and comprising one or more washing tubs.

Embodiments disclosed herein provide a laundry machine that includes a first washing tub that receives laundry, a housing disposed neighboring the first washing tub and having a predetermined space in the inside thereof, a second washing tub provided in the inside of the housing that receives laundry separately from the first washing tub, and a support member that supports the second washing tub against the housing, substantially preventing the displacement of the second washing tub due to its load, and limiting the displacement against the vibration of the second washing tub within a predetermined width or range. A case forming a space in the inside may be provided, and the housing may be installed to be received in the space of the case or to be able to be drawn in and out.

The support member may be provided between a first part vibrating integrally with the second washing tub and a second part vibrating integrally with the housing, and may be coupled not to be removed from the first part and the second part. The support member may be substantially made of a rigid body. The support member may be formed to be applied with tensile force due to the load of the second washing tub.

Also, the support member, both ends thereof being coupled not to be removed, respectively, in the first part vibrating integrally with the second washing tub and the second part vibrating integrally with the housing, may be formed to reduce the vibration by means of the friction force between the first part and the second part, when the vibration of the second washing tub is generated. The friction force generated when the second washing tub vibrates may be formed to be generated from the portion where the support member is coupled to the first part and the second part.

The support member may be made of material of a rigid body and may be coupled to be rotatable within a predetermined angle between the first part and the second part. The rotating angle of the support member may be limited within a predetermined angle by means of the interference between the support member and the first and second parts coupled to the support member.

The support member may be positioned in order that the second washing tub is returned to its initial position when the second washing tub does not vibrate. The support member may be applied with force couples where a virtual line connecting both ends of the support member intends to be vertical to the ground when the second washing tub does not vibrate. The support member may be formed to be applied with tensile force due to the weight of the second washing tub.

The laundry machine may further include a first bracket vibrating integrally with the second washing tub and formed with a first hole penetrating through the one side end of the support member, and a second bracket moving integrally with the housing and formed with a second hole penetrating through the other side end of the support member. The upper end of the support member may be formed to penetrate through the second hole, and the lower end of the support member may be formed to penetrate through the first hole.

The support member may further include constraint parts each provided in the ends penetrated through the first hole and the second hole not to be removed from the first hole and the second hole. The constraint parts may generate friction force by being rubbed with the inner circumferential surface of the first and second holes when the support member rotates.

The constraint parts each may be provided in the both side ends of the support member and may be formed to have a larger diameter than the first and the second holes. The portion of the support member penetrating through the first and second holes may be formed to have a clearance of a predetermined distance from the inner circumferential surfaces of the first and second holes.

The inner circumferential surfaces of the first and second holes may be formed in an arc shape forming a portion of a sphere. The portion of the constraint part connected to the inner circumferential surfaces of the first and second holes may be formed to have a spherical arc corresponding to the inner circumferential surfaces of the first and second holes. The surface of at least one side of the constraint part of the support member and the inner circumferential surfaces of the first and second holes, rubbed with each other, may be made of material maintaining friction force and preventing noise.

The laundry machine may further include an elastic support part elastically supporting right and left vibrations of the second washing tub. Additionally, the laundry machine may include an elastic support part, one end coupling to the first part and the other end coupling to the second part, to elastically support right and left vibration of the second washing tub Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry machine, comprising:

a cabinet;

a first washing tub that receives laundry disposed within the cabinet;

a housing disposed adjacent the cabinet;

a second washing tub provided within the housing that receives laundry; and at least one support that supports the second washing tub with respect to the housing, substantially preventing displacement of the second washing tub in a vertical direction due to the weight of the second washing tub and suppressing vibration and displacement of the second washing tub, wherein the at least one support comprises:

a first support bracket that moves integrally with the second washing tub;

a second support bracket that moves integrally with the housing; and a support member that is nonremovably coupled to extend between the first and second support brackets, wherein an upper part of the support member is suspended from the second support bracket, and wherein the first support bracket is suspended from a lower part of the support member.

2. The laundry machine as claimed in claim 1, further comprising a case, wherein the housing is installed in the case so as to be inserted into and withdrawn from the case.

3. The laundry machine as claimed in claim 1, wherein the support member comprises a substantially rigid body.

4. The laundry machine as claimed in claim 1, wherein the support member applies a tensile force in response to the weight of the second washing tub.

5. The laundry machine as claimed in claim 1, wherein the at least one support reduces vibration due to a friction force created between the support member and the first and second support brackets.

6. The laundry machine as claimed in claim 5, wherein the friction force is generated at portions where the support member is coupled to the first and second support brackets.

7. The laundry machine as claimed in claim 5, wherein the support member comprises a substantially rigid body and is coupled to be rotatable within a predetermined angle between the first and second support brackets when the second washing tub vibrates.

8. The laundry machine as claimed in claim 7, wherein the support member is configured to return the second washing tub to its initial position when the second washing tub does not vibrate.

9. The laundry machine as claimed in claim 1, wherein the first bracket is formed with a first hole through which one end of the support member penetrates, and the second bracket is formed with a second hole through which another end of the support member penetrates.

10. The laundry machine as claimed in claim 9, wherein an upper end of the support member penetrates through the second hole, and wherein a lower end of the support member penetrates through the first hole.

11. The laundry machine as claimed in claim 9, wherein the support member further comprises a plurality of constraint parts, each provided at an end thereof and configured to penetrate through the first hole and the second hole, respectively, so as not to be removed from the first hole and the second hole, respectively.

12. The laundry machine as claimed in claim 11, wherein the plurality of constraint parts generates friction force by rubbing with inner circumferential surfaces of the first and second holes when the support member rotates.

13. The laundry machine as claimed in claim 11, wherein the plurality of constraint parts is formed to have a larger diameter than a diameter of the first and the second holes.

14. The laundry machine as claimed in claim 9, wherein a portion of the support member penetrating through the first and second holes has a clearance of a predetermined distance from inner circumferential surfaces of the first and second holes.

15. The laundry machine as claimed in claim 12, wherein the inner circumferential surfaces of the first and second holes are formed in an arc shape forming a portion of a sphere, and wherein a portion of the plurality of constraint parts connected to the inner circumferential surfaces of the first and second holes is a spherical arc corresponding to the inner circumferential surfaces of the first and second holes.

16. The laundry machine as claimed in claim 12, wherein a surface of at least one side of the plurality of constraint parts of the support member and the inner circumferential surfaces of the first and second holes, which rub against each other, is made of a material that maintains a friction force and prevents noise.

17. The laundry machine as claimed in claim 1, further comprising at least one elastic support that elastically supports right and left portions of the second washing tub.

18. The laundry machine as claimed in claim 1, further comprising at least one elastic support part, one end of which is coupled to the second washing tub and the other end of which is coupled to the housing, to elastically support right and left portions of the second washing tub.

* * * * *